United States Patent [19]

Bolgiano et al.

[11] 4,210,691

[45] Jul. 1, 1980

[54] PHOTOCHEMICAL PROCESS FOR TREATING NYLON FIBER YARN OR PILE FABRIC

[76] Inventors: Nicholas C. Bolgiano, 824 Dorsea Rd., Lancaster, Pa. 17601; Daniel Swern, 7700B Stenton Ave., Philadelphia, Pa. 19118

[21] Appl. No.: 970,352

[22] Filed: Dec. 18, 1978

[51] Int. Cl.[2] ..... B32B 7/04

[52] U.S. Cl. ..... 428/96; 8/115.5; 8/DIG. 21; 204/159.15; 428/97; 428/913

[58] Field of Search ..... 428/85, 92, 96, 97, 428/364, 913; 8/115.5, 115.6, DIG. 21; 204/159.15

[56] References Cited

U.S. PATENT DOCUMENTS

| | | | |
|---|---|---|---|
| 3,090,664 | 5/1963 | Cline | 204/159.15 |
| 3,816,229 | 6/1974 | Bierbrauber | 428/96 |
| 3,987,227 | 10/1976 | Schultz | 428/96 |
| 4,107,055 | 8/1978 | Sukornick | 428/96 |

*Primary Examiner*—Marion McCamish

[57] ABSTRACT

A photochemical process for treating nylon fiber yarn or pile fabric is disclosed. Nylon fiber yarn or pile fabrics treated according to the process of this invention exhibit excellent cleanability.

7 Claims, No Drawings

PHOTOCHEMICAL PROCESS FOR TREATING NYLON FIBER YARN OR PILE FABRIC

This invention relates to nylon fibers.

More specifically, this invention relates to nylon fiber yarn or pile fabric which exhibits excellent cleanability.

In one of its more specific aspects, this invention relates to a photochemical process for treating nylon fiber yarn or pile fabric, which process facilitates the removal of soil from the yarn or fabric and, accordingly, cleaning of the yarn or fabric.

As used herein, the term "nylon fiber pile fabric" is understood to mean nylon upholstery fabric and nylon pile carpets having loop piles, cut piles, tip-sheared pile, random-sheared pile, as well as shag, plush, and sculptured piles.

Nylon fiber pile fabric, especially nylon carpet, is well known in the art, as is the need for methods to impart soil release properties to the fabric. One two-step process in which carpet pile is treated with different fluorochemical compositions is described in U.S. Pat. No. 3,816,229-Bierbrauer. U.S. Pat. No. 3,916,053-Sherman et al. discloses a process in which the fluoroaliphatic compound employed is the water insoluble addition polymer derived from a polymerizable ethylenically unsaturated monomer free of non-vinylic fluorine and a water insoluble fluorinated component.

The present invention provides yet another method for treating nylon fiber yarn or pile fabric to facilitate cleaning of the fabric.

According to this invention, there is provided a photochemical process for imparting soil release properties to nylon fiber yarn or pile fabric which comprises treating the nylon fiber yarn or pile fabric with an effective amount of an N-halogenating agent to break at least a portion of the amide hydrogen bonds on the amide linkages along the nylon molecular chain and form in place thereof photolabile nitrogen-halogen bonds; contacting the resulting nylon fiber yarn or pile fabric having photolabile nitrogen-halogen bonds with a vinyl monomer and irradiating the vinyl monomer treated nylon fiber yarn or pile fabric with sufficient actinic or electron beam radiation to (1) break the photolabile nitrogen-halogen bonds and form free radical host sites along the nylon molecular chain and (2) subsequently graft the vinyl monomer onto the nylon molecular chain at the free radical host sites.

Also according to this invention, there is provided a nylon fiber yarn or pile fabric produced by a photochemical process which comprises treating the nylon fiber yarn or pile fabric with an effective amount of an N-halogenating agent which serves to break the amide hydrogen bonds on the amide linkages along the nylon molecular chain and form in place thereof photolabile nitrogen-halogen bonds; contacting the resulting nylon fiber yarn or pile fabric having photolabile nitrogen-halogen bonds on the amide linkages along the nylon molecular chain with a vinyl monomer and irradiating the vinyl monomer treated nylon fiber yarn or pile fabric with sufficient actinic or electron beam radiation to (1) break the photolabile nitrogen-halogen bonds and form free radical host sites along the nylon molecular chain and (2) subsequently graft the vinyl monomer onto the nylon molecular chain at the free radical host sites.

As used herein, the term "N-halogenating agent" is understood to mean a material which serves to break nitrogen-hydrogen bonds on the amide linkages of nylon and substitute halogens for at least a portion of the hydrogens.

Any suitable vinyl monomer can be employed.

Particularly suitable vinyl monomers include acrylic acid, acrylonitrile, methacrylamide, acrylamide, 2-hydroxyethyl acrylate, hydroxypropylacrylate and esters having the general formula

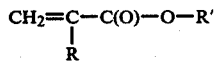

wherein R represents hydrogen or a methyl group and R′ represents an alkyl group having from 1 to 10 carbon atoms.

In the practice of this invention, any suitable N-halogenating agent can be employed.

Suitable N-halogenating agents include hypochlorous acid, t-butyl hypochlorite, N-chloro succinimide, N-bromo acetamide, N-chloro acetamide, and the like.

Hypochlorous acid is a particularly suitable N-halogenating agent for use in this invention. However, hypochlorous acid is highly unstable. Accordingly, in one embodiment of this invention, hypochlorous acid is generated in situ on the nylon fiber yarn or pile fabric by the reaction of an aqueous solution of a metallic salt of hypochlorous acid and a weak acid.

In the above embodiment, as the aqueous solution of a metallic salt of hypochlorous acid, use can be made of aqueous solutions of sodium hypochlorite, calcium hypochlorite, potassium hypochlorite or barium hypochlorite containing from about 0.1 to about 5 percent by weight chlorine.

Any suitable weak acid can be used which, when reacted with a metallic salt of hypochlorous acid, results in the formation of hypochlorous acid. Particularly suitable weak acids include acetic acid, acrylic acid, and the like.

If hypochlorous acid is generated in situ on the yarn or fabric, this invention can be carried out by first applying an aqueous solution of a metallic salt of hypochlorous acid to the nylon yarn or pile fabric, followed by a second and third application of a weak acid and a vinyl monomer, respectively. However, the following alternative methods are preferred since they avoid the need for the separate application of each of the three materials.

This invention can also be carried out by applying an aqueous solution of a metallic salt of hypochlorous acid, followed by the subsequent single application of a premixed solution of the weak acid and vinyl monomer. The premixed solution can be prepared by adding the two materials to a mix tank at room temperature with agitation in a parts by weight ratio of weak acid to vinyl monomer of from about 1 to 4:4 to 1. This method is fully demonstrated in Example I.

Alternatively, if acrylic acid is selected as the weak acid, it is preferably employed in an amount in excess of the amount needed to neutralize or convert the metallic salt of hypochlorous acid to hypochlorous acid. If acrylic acid is employed in excess, it is no longer necessary to subsequently apply a vinyl monomer. This is because, in the practice of this invention, acrylic acid, if employed in excess, will serve both as a weak acid and as a vinyl monomer. This method is fully demonstrated in Example II.

To prepare a nylon fiber yarn or pile fabric of this invention, an N-halogenating agent is applied to any conventional nylon fiber yarn or pile fabric greige goods which have been conventionally scoured to remove any previous coating on the nylon fiber, using any suitable method of application; for example, dipping and squeezing on a Kuester chemical padder, such that the greige goods possess a weight percent pickup of the N-halogenating agent within the range of from about 5 to about 200.

If the N-halogenating agent, hypochlorous acid, is generated in situ, the metallic salt of hypochlorous acid can be applied in the same manner and within the same weight percent pickup range as an N-chlorinating agent. The weak acid can be subsequently applied using any suitable method of application, for example, spraying or painting, such that the resulting greige goods possess at least enough weak acid to neutralize the aqueous solution of the metallic salt of hypochlorous acid.

The resulting greige goods now possess photolabile nitrogen chlorine bonds and, at this point, can be oven dried at a temperature within the range of from about 50° F. to about 300° F. Preferably, the griege goods are not dried but treated or contacted with a vinyl monomer using any suitable method of application, for example, spray application, such that the resulting greige goods possess from about 0.1 to about 5% by weight vinyl monomer based on the dry weight of the nylon fiber. Alternatively, the vinyl monomer and weak acid can be mixed and applied in a single application.

If hypochlorous acid is generated in situ by using an excess amount of acrylic acid or by the application of a premixed solution of the weak acid and vinyl monomer, the separate application of a vinyl monomer can be eliminated.

The resulting treated greige goods are then exposed to either a source of actinic or electron beam radiation which initiates graft polymerization of the vinyl monomer onto the free radical host sites resulting from the breaking of the photolabile nitrogen-halogen bonds. If ultraviolet radiation is employed, it is preferably carried out in an oxygen free atmosphere.

The resulting greige goods are then water washed, dried, and recovered as a nylon fiber yarn or pile fabric of this invention.

The above method, as well as the following examples, for preparing a nylon fiber pile fabric are understood to be similarly applicable to nylon fiber yarn.

Having described the ingredients and methods of this invention, reference is now made to the following examples which are provided by way of illustration and not limitation of the practices of this invention.

EXAMPLE I

This example demonstrates a method for producing a nylon fiber pile fabric of this invention using a premixed solution of weak acid and vinyl monomer.

An 8.6 gram, 4"×4" sample of nylon carpet greige goods (⅛" gauge, ¼" pile height, and 28-½ oz./sq. yd. pile weight) produced using Antron III Nylon 6—6 yarn (1225/3, alternating S and Z ply), commercially available from Dupont, was conventionally scoured and dipped into a dip tank containing an aqueous solution of sodium hypochlorite (2.5% by weight NaOCl) at room temperature and maintained in the dip tank for about 2 minutes.

The sample was removed from the dip tank and squeezed on a Kuester chemical padder at a pressure of about 65 lbs/sq. in. The sample was found to contain about 155 weight percent pickup (13.3 grams) of hypochlorite solution.

To a premix container were added about 7 parts by weight acetic acid and about 5 parts by weight acrylamide at room temperature with stirring. The resulting mixture was hand-sprayed onto the greige goods sample such that the resulting sample possessed about 13.5 grams of the mixture or about a 62 weight percent pickup.

The sample was then subjected to an intensity of UV light equal to about 4 joules/cm$^2$ (3 passes at 8 ft./sec.) in a nitrogen atmosphere using a 200 watt/inch medium pressure mercury lamp.

The sample was water washed to remove contaminants, oven dried at a temperature of about 200° F., and recovered as a nylon fiber pile fabric of this invention.

The resulting sample was then tested using a Fourier Transform Infrared Spectrophotometer, and the resulting spectroanalysis indicated that grafting of acrylamide onto the nylon molecular chain had occurred.

EXAMPLE II

This example demonstrates the best mode for producing a nylon fiber pile fabric of this invention using an amount of acrylic acid in excess of the amount needed for neutralization of the metallic salt of hypochlorous acid—the excess acrylic acid serving as a vinyl monomer.

A 310 gram, 15"×22" sample of nylon carpet greige goods (3/16 inch gauge, ⅞ inch pile height, and 40 oz./sq. yd. pile weight) produced using Nylon 6 staple fiber (2.75/2, heat set twist 4.75S) was conventionally scoured and dipped into a dip tank containing an aqueous solution of sodium hypochlorite (2.5% by weight NaOCl) at room temperature and maintaind in the dip tank for about 2 minutes.

Next, the sample was removed from the dip tank and squeezed on a Kuester chemical padder at a pressure of about 65 lbs./sq. in. The sample was found to contain about a 110 weight percent pickup (340 grams) of hypochlorite solution or about 8.5 grams of sodium hypochlorite.

About 25 grams of a weak acid, acrylic acid, was then handsprayed onto the greige goods sample in a plastic tent which served to contain the acrylic acid and its vapors. About 8.3 grams of acrylic acid are required to neutralize about 8.5 grams of sodium hypochlorite. Accordingly, an excess of about 16.5 grams (25 grams–8.5 grams required for neutralization) of acrylic acid was applied.

After about two days' exposure, the sample was removed from the vapor and irradiated in a nitrogen atmosphere using a 200 watt/inch medium pressure mercury lamp to an intensity of radiation equal to about 4 joules/cm$^2$ (3 passes at 8 ft./sec.).

The sample was then washed with water to remove contaminants, e.g., unreacted monomer, oven dried at about 200° F. for about two hours, and recovered as a nylon fiber pile fabric of this invention. The sample was tested (using a Soxhlet extraction apparatus—24 hour continuous water extraction) and found to possess about 0.89% by weight of grafted acrylic acid based on fiber weight.

The sample of Example II and a control sample of the same carpet (not treated according to this invention) were subjected to about 15,000 underfoot traffic counts to soil the sample to substantially the same degree. Both samples were then dry vacuumed and subsequently steam cleaned.

After dry vacuuming, the sample of Example II was observed to be noticeably cleaner than the control sample.

Likewise, after steam cleaning, the sample of Example II was observed to be noticeably cleaner than the control sample.

The sample of Example II was again tested to determine acrylic acid content and was found to possess 0.48% by weight of grafted acrylic acid.

What is claimed is:

1. A photochemical process for imparting soil release properties to nylon fiber yarn or pile fabric which comprises treating the nylon fiber yarn or pile fabric with an effective amount of a N-halogenating agent to break at least a portion of the amide hydrogen bonds on the amide linkages along the nylon molecular chain and form in place thereof photolabile nitrogen-halogen bonds; treating the resulting halogenated nylon fiber yarn or pile fabric having photolabile nitrogen-halogen bonds with a vinyl monomer and irradiating the vinyl monomer treated nylon fiber yarn or pile fabric with sufficient actinic or electron beam radiation to (a) break the photolabile nitrogen-halogen bonds and form free radical host sites along the nylon molecular chain and (b) subsequently graft the vinyl monomer onto the nylon molecular chain at the free radical host sites.

2. The process of claim 1 in which said N-halogenating agent is selected from the group consisting of hypochlorous acid, t-butyl hypochlorite, N-chloro succinimide, N-bromo acetamide, and N-chloro acetamide.

3. The process of claim 1 in which said vinyl monomer is selected from the group consisting of acrylic acid, acrylonitrile, methacrylamide, acrylamide, 2-hydroxyethyl acrylate, hydroxypropyl-acrylate and esters having the general formula $$CH_2{=}\underset{\underset{R}{|}}{C}{-}C(O){-}O{-}R'$$

wherein R represents hydrogen or a methyl group and R′ represents an alkyl group having from 1 to 10 carbon atoms.

4. The process of claim 1 in which said N-halogenating agent is hypochlorous acid which is generated in situ by the reaction of an aqueous solution of a metallic salt of hypochlorous acid and a weak acid.

5. The process of claim 4 in which said metallic salt of hypochlorous acid is selected from the group consisting of sodium hypochlorite, calcium hypochlorite, potassium hypochlorite, and barium hypochlorite.

6. The process of claim 4 in which said weak acid is acetic acid or acrylic acid.

7. A nylon fiber yarn or pile fabric produced by a photochemical process which comprises treating the nylon fiber yarn or pile fabric with an effective amount of an N-halogenating agent which serves to break the amide hydrogen bonds on the amide linkages along the nylon molecular chain and form in place thereof photolabile nitrogen-halogen bonds; contacting the resulting halogenated nylon fiber yarn or pile fabric having photolabile nitrogen-halogen bonds on the amide linkages along the nylon molecular chain with a vinyl monomer and irradiating the vinyl monomer treated nylon fiber yarn or pile fabric with sufficient actinic or electron beam radiation to (a) break the photolabile nitrogen-halogen bonds and form free radical host sites along the nylon molecular chain and (b) subsequently graft the vinyl monomer onto the nylon molecular chain at the free radical host sites.

* * * * *